US006726314B2

(12) United States Patent
Van Roy

(10) Patent No.: US 6,726,314 B2
(45) Date of Patent: Apr. 27, 2004

(54) APPARATUS FOR TRANSPORTING FLUID INK, AND A FLEXIBLE HOSE SUITABLE FOR SUCH TRANSPORTATION APPARATUS

(75) Inventor: Antonius P. M. M. Van Roy, Helden (NL)

(73) Assignee: Oce Technologies B. V., Ma Venlo (NL)

( * ) Notice: Subject to any disclaimer, the term of this patent is extended or adjusted under 35 U.S.C. 154(b) by 0 days.

(21) Appl. No.: 10/196,178

(22) Filed: Jul. 17, 2002

(65) Prior Publication Data

US 2003/0025772 A1 Feb. 6, 2003

(30) Foreign Application Priority Data

Jul. 17, 2001 (NL) ..... 1018564

(51) Int. Cl.[7] ..... B41J 2/175
(52) U.S. Cl. ..... 347/85
(58) Field of Search ..... 347/84–87, 49; 248/75; 137/848; 239/11; 138/118, 137, 140, 141

(56) References Cited

U.S. PATENT DOCUMENTS

| | | | | |
|---|---|---|---|---|
| 5,988,801 A | * 11/1999 | Coiner | ..... | 347/85 |
| 6,003,981 A | 12/1999 | Cameron et al. | ..... | 347/85 |

FOREIGN PATENT DOCUMENTS

| | | | | |
|---|---|---|---|---|
| EP | 0 722 835 A1 | 7/1996 | ..... | B41J/2/01 |
| EP | 0 778 142 A1 | 6/1997 | ..... | B41J/2/175 |
| EP | 0 956 960 A2 | 11/1999 | ..... | B41J/2/175 |
| JP | 02-151674 | 6/1990 | ..... | C09D/11/00 |
| JP | 05-042680 | 2/1993 | ..... | B41J/2/175 |
| JP | 08-011480 | 1/1996 | ..... | B43K/7/02 |
| WO | 98/31546 A1 | 7/1998 | ..... | B41J/2/175 |

* cited by examiner

*Primary Examiner*—Juanita D. Stephens
(74) *Attorney, Agent, or Firm*—Birch, Stewart, Kolasch & Birch, LLP

(57) ABSTRACT

A printing apparatus containing a printhead, an ink reservoir and a flexible hose for transporting fluid ink from the ink reservoir to the printhead, wherein the flexible hose has a wall which, during the transportation of the ink, is in contact with the ink, said wall being made of a material which is impermeable or almost impermeable to water and air, and in additional is substantially resistant to carbon-containing ink.

12 Claims, 2 Drawing Sheets

APPARATUS FOR TRANSPORTING FLUID INK, AND A FLEXIBLE HOSE SUITABLE FOR SUCH TRANSPORTATION APPARATUS

BACKGROUND OF THE INVENTION

1. Field of the Invention

The present invention relates to an apparatus for transporting fluid ink from an ink reservoir to a printhead, which includes a flexible hose having a wall which is in contact with the ink during the transportation, said wall being made of a material which is impermeable or almost impermeable to water and air. The present invention also relates to a hose suitable for transporting fluid ink and the use of such a hose for transporting fluid ink.

An apparatus of this kind is known from U.S. Pat. No. 6,003,981. From this patent specification it is known to use such an apparatus in a large format inkjet printer. In such a printer, a number of printheads carried on a scanning carriage are provided with aqueous ink, the ink being fed from an equal number of reservoirs by means of a plurality of flexible hoses. By using hoses of sufficient length it is possible to provide ink to the printheads even during the printing operation, during which the printheads are constantly moved with respect to a receiving material being printed. In this way printing need never be interrupted to add ink to the printheads.

From the patent specification it is known that the hoses which are utilized possess a number of properties which make them suitable for the described use. The hoses are impermeable or practically impermeable to water (water vapor in this case) and to air. If they are permeable to water, then the ink will lose some of its water through the wall of the hose so that the ink properties change. The ink becomes more viscous which makes it more difficult to jet and there is also created a risk of clogging of the fine nozzles with which the ink is finally jetted from the printhead. Permeability to air can result in too much air being absorbed (or any gas or mixture of gases whatsoever in the printer environment) by the ink. This can also affect print quality or even result in a breakdown of the printing elements (which often contain fine ink ducts in the printhead). In addition, through the absorption of air from the environment, it is difficult to maintain a negative pressure in the ink supply system, and this is necessary in order to avoid ink leakage at the front of the print head. In addition to being substantially impermeable to water and air, the hoses must be flexible, i.e. their modulus must also be sufficiently small since otherwise excessive forces will be exerted on the scanning carriage. In addition, the sensitivity to kinking is relatively considerable in hoses which are not flexible. Kinking is undesirable because the ink supply which is conveyed through the associated hose experiences too great a resistance. Finally, the hoses are preferably durable so that they can retain all of these desired properties for a long time, typically corresponding to some hundreds of thousands and even millions of passes of the scanning carriage. According to the patent specification, for this purpose hoses are used which are made of polyvinylidene-chloride copolymer (PVDC). Such materials, which typically contain 80% vinylidene chloride monomer and 20% vinyl chloride monomer meet the above requirements. However, when such hoses are used, it has been found that the printheads at the front, i.e. the side from where the ink is jetted, become very soiled with ink after a long and intensive use. Such soiling has a negative influence on the print quality, on the one hand, because the jetting of the ink is influenced by the presence of soiling around the nozzles, and on the other hand, because the ink could drip unwantedly onto the receiving material for printing. It has also been found that when the ink is stationary in the hoses for a long period intensive clotting or thickening of the ink occurs in the hoses despite the fact that the wall of the hose is substantially impermeable to water. Such clotting or thickening results in clogging of the hose and accordingly a breakdown of the corresponding printheads. These effects are particularly present when black ink is used.

SUMMARY OF THE INVENTION

The object of the present invention is to provide an apparatus which, even with long and intensive use, does not result in intensive soiling of the front of the printhead and wherein the hoses do not clog, even if the ink is stationary within the hoses for long periods of time. To this end, a hose and a printing apparatus has been developed wherein the hose material is made to be substantially resistant to carbon-containing ink.

It has surprisingly been found that the hose according to the present invention does not result in the soiling of the front of the printhead and that the ink, even if it is stationary within the hose for a long period of time, does not show any propensity for clotting or thickening such that the hose containing this ink would tend to clog. The reason for this is not completely clear, but it would appear that in the known hoses there is at least a partial disintegration, chemical and/or physical, of the hose material which takes place in the presence of carbon particles which are frequently used as the black pigment in the ink. The probable cause of the problems is that the disintegration products or specific components from which the material of the hose is made tend to collect at the front of the printhead where it can be more readily wetted by ink leading to a considerable soiling of the printhead. The clotting or thickening of the ink is possibly the result of a gelling process because, despite the non-evaporation of water through the wall of the hose, a considerable thickening of the ink nevertheless occurs. Possibly one or more disintegration products or other substances originating from the material of the hose act as a gelling agent in the ink. With the use of an apparatus in which the material is resistant to carbon-containing ink, i.e. the material experiences no substantial change when in contact with such an ink for a long period of time, these problems do not occur at least occur less rapidly, under the above circumstances. The skilled man can readily determine whether a material experiences such a substantial change. For example, the mechanical properties and/or the composition of the material, either quantitatively or qualitatively, before and after exposure to ink for a long period of time, for example, for several months up to a year, can be determined. If the properties have do not substantially changed, then it is a material according to the invention and with it an apparatus according to the invention can be obtained. Furthermore, it is immaterial to the present invention whether or not the material is homogeneous, a blend, a composite, or of any consistency.

It is also known from WO 98/31546 to use hoses wherein at least the inner wall is made of polythene or polytetrafluoroethylene (Teflon). Polythene materials are substantially impermeable to water (water vapor in this case) but they have been found to have a relatively highly permeability to air or other gases. Consequently such hoses do not meet the requirements for high-grade use. The hoses made of Teflon are very stiff and hence not flexible. This restricts the possible applications of such hoses. Therefore, they are even further removed from the present invention.

In one embodiment, the material of the hose is an alkylene alkyl-acrylate copolymer, wherein the alkylene moiety is selected from the group consisting of ethylene and propylene and the alkyl-acrylate moiety is selected from the group consisting of methyl, ethyl, propyl and butyl acrylate. It has been found that a material of this kind can be used in a printing apparatus according to the present invention because it has been found to be resistant to carbon-containing inks. Even with very long exposure to such ink, the material exhibits no perceptible change in properties or composition. Also, it has been found that this material can be easily processed to form hoses, for example by extrusion. This is surprising because the high melt flow index (MFI) of such acrylate copolymers would lead one to expect that this material would be difficult to process, if it could be processed at all, in such a process.

In another embodiment, the material is a copolymer of ethylene with the alkyl-acrylate. With a copolymer of this kind it is possible to make a hose which is even more flexible and has less tendency to kinking so that the risk of the hose being closed off is further reduced. Also, this material is relatively cheap.

In another embodiment, the alkyl-acrylate is selected from the group consisting of methyl and ethyl acrylate. Such copolymers are very flexible and pass even less water than the propyl and butyl acrylates. In this way the apparatus according to the present invention can be further improved. In a preferred embodiment, the copolymer is an ethylene methyl acrylate. It has been found that such a copolymer is the most flexible and that the water and air permeability are minimized. The resistance to carbon is also good.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
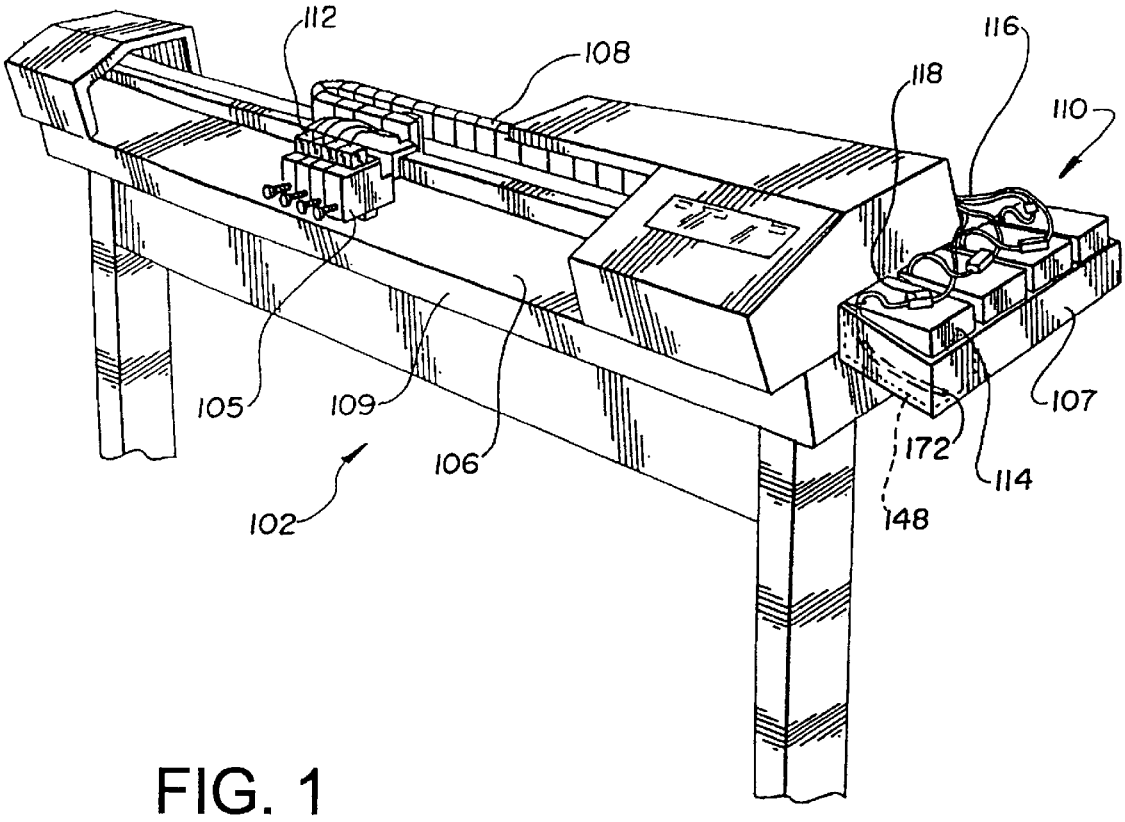
FIG. 1 is a diagram of an inkjet printer provided with a device for conveying ink from reservoirs to the printheads (prior art)
Figure 2:
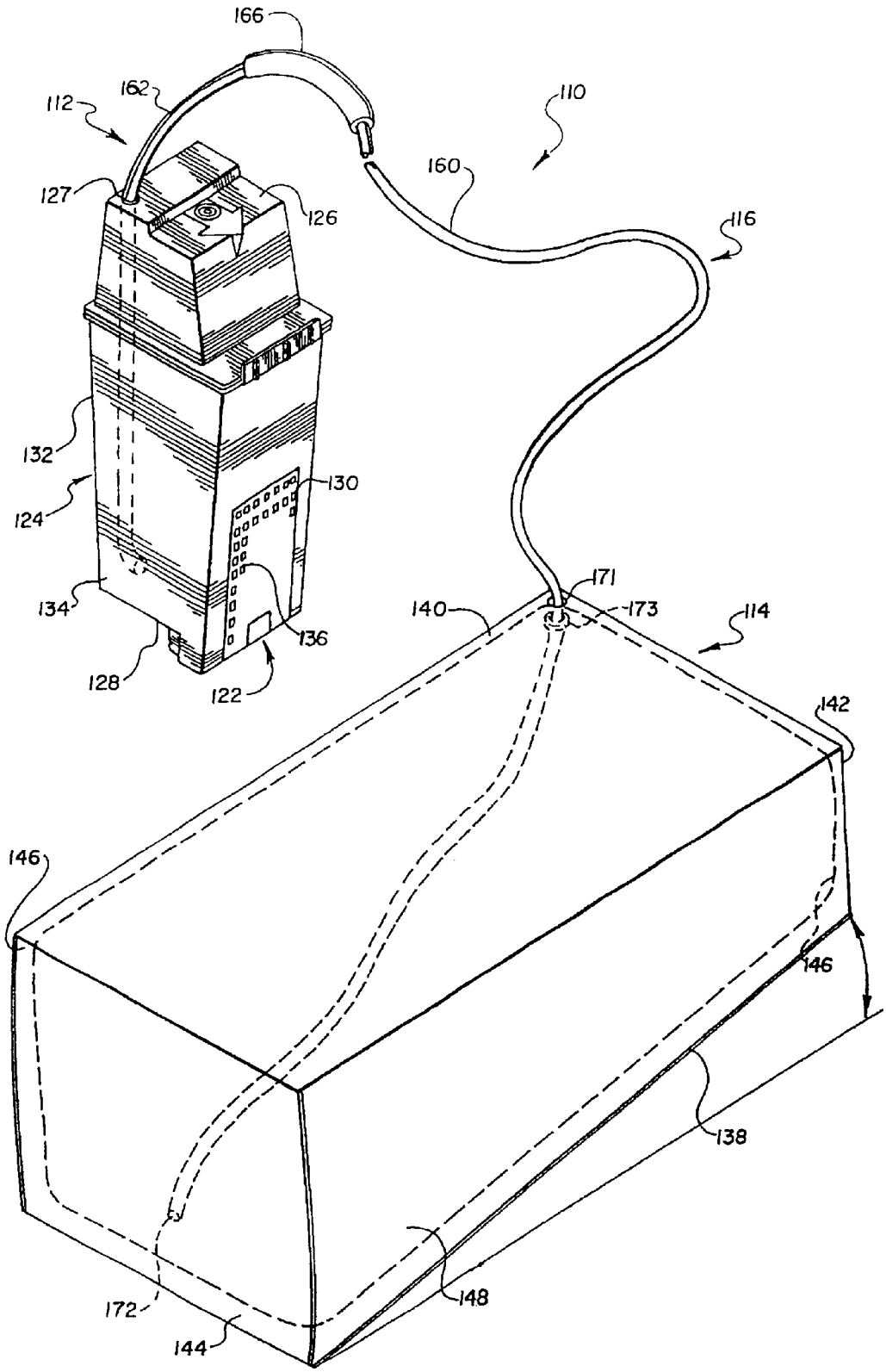
FIG. 2 is a diagram showing some portions of the printer in greater detail.

FIG. 1 is a perspective view of an inkjet printer 102 provided with a guide surface 109 for guiding receiving material 106 and a plurality of printheads 112 which are shown in greater detail in FIG. 2. The printer 102 is also provided with a device 110 for transporting ink from reservoirs 114 to the printheads 112 for the continuous replenishment of ink to the printheads. The reservoirs 114 are carried by a support element 107. Each of the reservoirs 114 contains an ink sac 148. The apparatus comprises a set of connecting elements 116 which each extend from a first end 172 in an ink sac 148 via a flexible conductor 108 to a second end connected to a printhead 112. Each of the elements 116 is provided with a valve 118 by means of which the ink flow can be shut off and re-opened. The printheads 112 are carried by a scanning carriage 105. Since the support element 107 is at a level lower than that of the scanning carriage 105, there is a small negative pressure acting on each of the printheads 112 if the valve 118 is open. This prevents the fluid ink from running out of the printheads 112 by itself and soiling the receiving material 106. During the printing of the receiving material 106, for example a sheet of paper, the scanning carriage 105 moves laterally over a guide system with respect to the horizontally oriented receiving material 106. Each of the printheads comprises a plurality of print elements (not shown), from which individual ink drops are jetted onto the receiving material. In this way, a strip of the receiving material of a width of a printhead is printed in one or more passes. The receiving material is then advanced in a transit direction of the printers so that a following strip can be printed.

During printing, a negative pressure is generated in each of the printheads as a result of the jetting of ink. This negative pressure is greater than the hydrodynamic vacuum as a result of the difference in levels between the scanning carriage 105 and the support element 107. As a result, ink will be drawn practically continuously through the printheads 112 from the ink reservoirs 114 via the connecting elements 116. In this way, there is no need to interrupt the printing operation, even if large-format images have to be printed for a long period of time, despite the fact that the printheads 112 as such have only a low ink capacity (typically some tens of cc's). As a result of the continuous supply of ink from reservoirs 114, which contain a quantity of ink of typically 500 to 1000 cc, the heads can, for a long time be provided with fluid ink without any need to add ink.

FIG. 2 is a diagram showing a number of parts of the printer in greater detail, and particularly the apparatus for conveying the ink. In this embodiment, the printhead 112 comprises an ink holder 124, provided with a top part 126, a base 128, a front 130, a rear 132 and two side surfaces 134. At the front 130 of the printhead 112 it is just possible to see a part of printing unit 122, which is mostly situated at the bottom of the printhead. This print unit is provided with a large number of internal fine ink ducts (not shown), which have a typical diameter of 10–40 $\mu$m. Each of the ducts is in contact with ink situated in the ink holder 124. Each duct terminates at the bottom 128 in a nozzle (not shown), through which ink drops can be jetted in the direction of guide surface 109. For this purpose, each duct is provided with means (not shown) for suddenly greatly increasing the pressure in the duct so that a drop of ink is jetted at the front from the corresponding duct. These means are actuated via contacts 136. As described hereinbefore, the printhead 112 is in contact with ink reservoir 114 via a connecting element 116. In this embodiment, the reservoir 114 is a substantially rectangular box with a base 138, a top 140, a small reservoir end 142, a large reservoir end 144 and opposite reservoir sides 146. The reservoir sides 146 are trapezoidal in shape because the reservoir base 138 extends obliquely upwards from the reservoir end 144 to the smaller reservoir end 142. Since the reservoir base extends up over a small angle of typically 10°, provision is made for the ink contained in the reservoir to be practically, completely sucked up by the printhead 112. This provides the user with a saving in ink consumption. The connecting element 116 between the printhead 112 and the reservoir 114 in this embodiment contains a deformable but substantially rigid tube 162, a flexible hose 160 and a connecting member 166. At the rear 132 of ink holder 112 the tube 162 is introduced into the ink holder 124 via a passage hole 127 in the top 126 and extends into the ink holder 124 to the vicinity of the bottom 128. Via the connecting member 166 the tube 162 is connected to flexible hose 160. It is a flexible hose of this kind to which the invention relates. The hose has one end 172 terminating in the low-level part of the reservoir 114. The hose 160 enters the reservoir via an opening 171 therein. The hose is provided with means for relieving tension by fixing it practically directly behind the opening 171 to a ring 173 which is permanently connected to the reservoir wall 142. As a result, the hose 162 will remain in the reservoir without any internal tension, even when the scanning carriage 105 moves in reciprocation with respect to the printer guide surface 109.

During printing, ink will be jetted from the nozzles of the print unit 122. This results in a negative pressure in the corresponding ink ducts. Since these ducts communicate with the ink in ink holder 124, ink in the ink holder 124 will be drawn in by this negative pressure. This results in a vacuum in the ink holder. Since the latter, in turn, communicates with ink reservoir 114 via connecting member 116, ink will be drawn in from the reservoir 114. In this way, the quantity of ink in the ink holder 124 is always at a functional level.

EXAMPLE 1

This example indicates the sensitivity of various materials to disintegration in carbon-containing ink and the clogging of the hoses made from these materials.

For this purpose, hoses made from these materials were subjected to the following test. A homogeneous hose was taken from each material with an internal diameter of about half a centimeter. From this, a piece approximately 10 cm long was cut off. Each piece of hose was then placed in a dish and immersed in Lexmark Black ink, which is a carbon-pigmented ink. The pieces of hose were maintained in this state for a period of 8 months at a constant temperature of 40° C. After 8 months, the pieces of hose were removed from the ink. Each piece of hose was then checked to see whether any clogging had occurred in the hose. The pieces of hose were then cleaned and dried and the net mass change was determined. This mass change is an index of the resistance of the hose to the carbon-containing ink. Table 1 shows the findings and measurements.

Table 1

This Table shows the sensitivity of various materials to disintegration in carbon-containing ink and the clogging of hoses made from these materials.

TABLE 1

This Table Shows the sensitivity of various materials to disintegration in carbon-containing ink and the clogging of hoses made from these materials.

| Mark | Type | Material | Mass change (%) | Clogging |
|---|---|---|---|---|
| Meldon | 5469125 | PVC | −1.42 | Yes |
| Meldon | 5369007 | PVC | −2.29 | Yes |
| RIA | PVC | PVC | −9.08 | Yes |
| Glasmag | 2.4/4.0 | PVC | −6.65 | Yes |
| Tygon | F-4040-A | PVC | −1.27 | Yes |

TABLE 1-continued

This Table Shows the sensitivity of various materials to disintegration in carbon-containing ink and the clogging of hoses made from these materials.

| Mark | Type | Material | Mass change (%) | Clogging |
|---|---|---|---|---|
| Tygon | S-50-HL | PVC | −2.58 | Yes |
| Tygon | R-3603 | PVC | −2.71 | Yes |
| Tygon | R-1000 | PVC | −1.79 | Yes |
| Tygon | B-44-3 | PVC | −2.11 | Yes |
| Fischer | PE-flex | PE | +0.60 | No |
| Tygon | 2075 | PE | +0.46 | No |
| RIA | TPE | PE | +0.30 | No |
| Parker | PE-flex | PE | +0.34 | No |
| Fluran | Viton | fluorine rubber | +1.62 | No |
| Nitto | PTFE | Teflon | 0 | No |
| — | — | EMA | +0.50 | No |

Table 1 indicates that nine different types of PVC (polyvinylchloride) were tested. This material is frequently used because it is practically impermeable to gases and water. The first two PVC materials are made by Meldon, and then PVC materials were tested from RIA, Glasmag and Tygon. It was found that all these materials gave rise to clogging of the hose with clotted and/or gelled ink. In addition, all of the materials showed a weight change of more than 1%, including the Pharma grade (S-50-HL) and Food & Drink grade (B-44-3) of Tygon. This indicates that these materials are basically not resistant to the carbon-containing ink. In the handling of the PVC hoses it was also found that they had acquired different mechanical properties due to the long-term exposure to the ink. Their flexibility had fallen off to some extent and the sensitivity to kinking was increased.

In addition, four PE (polythene) materials were tested in this way. None of these materials showed any clogging of the hose and in addition they were found to be substantially resistant to the carbon-containing ink because the mass change was less than 1%.

The two fluorine-containing materials (Viton and Teflon) did not show any clogging of the hoses. In addition, Teflon appears to be completely inert under these conditions, and no mass change whatever was found. On the other hand, the Viton rubber, which also has the disadvantage that it is not transparent and very expensive, showed a mass change of 1.62%, in this case an increase in mass. Apparently this fluorine rubber is not resistant to the carbon-containing ink but absorbs a considerable amount of water. Due to this swelling, the permeability to water, which is initially practically zero, has been found to rise sharply. This is a significant disadvantage toward using a hose of this kind for conveying ink.

The last material tested (EMA) is a copolymer of ethylene and methylacrylate. Hoses of this material are not available commercially, so that the applicants themselves made a hose of this material as indicated below in Example 4. It was found that this material is substantially resistant to the carbon-containing ink because the mass change was only 0.5%. In addition, there was no clogging of the hose. Nor could any perceptible change be found in mechanical properties in the handling of the hose after the termination of the test.

EXAMPLE 2

This example indicates the permeability of flexible hoses of the various types of material to air and water. For this purpose, Table 2 gives the permeability coefficient to oxygen for various materials. This coefficient is a good indication of permeability to gas generally and air in particular. A low permeability to air is important for use with a material as a hose for the transportation of ink in inkjet printers.

The permeability coefficient as indicated can be determined by connecting the hose to an oxygen pipe and then shutting it off. The coefficient can now be calculated by measuring the quantity of oxygen passing through the wall of the hose during a certain period of time, at a certain oxygen pressure in the hose. The permeability coefficient can then be calculated in accordance with formula I:

$$PC=V\times d/A\times t\times \Delta p \quad \text{(I)}$$

wherein

PC=permeability coefficient [$cm^2$/s cmHg]

V=quantity of diffused gas [$cm^3$]

d=thickness of the hose wall [cm]

A=area of the hose wall [$cm^2$]

t=measuring time [sec]

Δp=pressure drop over the hose wall [cmHg]

TABLE 2

Order of magnitude of permeabilty coefficient for various types of material with respect to oxygen.

| Type of material | PC × $10^{-11}$ [$cm^2$/s cmHg] |
|---|---|
| PVC | 20–250 |
| Fluorine-containing | 10–15 |
| PE | >1000 |
| Alkylene alkyl-acrylate copolymer | 50–250 |

It will be apparent from Table 2 that the PVC materials of the type indicated in Example 1 have a relatively low permeability coefficient which makes them practically impermeable to air. Fluorine-containing materials such as Viton rubber and Teflon scarcely pass any perceptible quantity of oxygen therethrough and can accordingly be regarded as impermeable to air. Polythene materials, however, appear very permeable to oxygen and consequently also to air. This makes materials of this kind much less suitable for use as a hose for conveying ink. Finally, permeability coefficients were also determined for alkylene alkyl-acrylate copolymers, at least copolymers according to one embodiment of the present invention. These coefficients were found to have an oxygen permeability comparable to that of the PVC materials. This means that these copolymers are practically impermeable to air and hence very suitable for forming hoses for the transportation of ink.

The permeability of the various materials to water can be determined as indicated in WO 98/31546. It has been found that PE materials have a scarcely measurable permeability to water. PVC passes somewhat more water but can also be regarded as practically impermeable to water (hence PVC, which as indicated hereinbefore is also practically impermeable to air, is often used for making rubber boats and the like). The tested fluorine-containing materials as indicated in Example 1 are also practically impermeable to water. As indicated hereinbefore, fluorine rubbers, however, lose their impermeability to water in the case of long-term use. The alkylene alkyl-acrylate copolymers according to one embodiment of the invention were also found to be practically impermeable to water.

EXAMPLE 3

This example deals with the flexibility of a number of materials. To quantify the flexibility of a material, numerous and often empirical measurements are known from the prior art. However, it has been found that the flexibility of a material is well correlated to the E-modulus of the material. The E-modulus in turn depends on the hardness of the material. In this way, an indirect measure of flexibility can be obtained by measuring the hardness of the material. Generally, the harder a material, the less flexible that material is. Also, a harder material is often more sensitive to kinking. For use as a transportation hose in an inkjet printer a flexible hose is desirable.

Hardnesses of rubber materials can be measured in accordance with DIN Standard D2240 and are expressed in Shore-A. It has been found that PVC materials of the type as indicated under Example 1 have a low hardness, typically lower than 200, and preferably lower than 100 Shore-A, and can be termed flexible. Polythene and particularly Viton are also flexible because their hardness is typically lower than the above values. All of these materials have also been found to be practically insensitive to kinking. Teflon, on the other hand, is so hard that its hardness cannot be given in Shore-A but is expressed in Shore-D (a typical hardness of Teflon is 60 Shore-D), and this means that this material is factors harder. Hoses made from this material are accordingly not flexible and also very sensitive to kinking. Alkylene alkyl-acrylate copolymers according to one embodiment of the invention really are flexible. EMA in particular is very flexible and practically insensitive to kinking. The hardness of EMA rubber measured in accordance with the above Standard is about 78 Shore-A.

EXAMPLE 4

This example indicates how a flexible hose can be made from an alkylene alkyl-acrylate copolymer despite the fact that the alkylene alkyl-acrylate copolymers according to the present invention have a high MFI, it has been found that they can be very well processed to form hoses by extrusion. It is also a simple matter to make multi-layer hoses with this material, for example a hose with an inner wall of an alkylene alkyl-acrylate copolymer and one or more following layers of any material, depending on any additional requirements.

The Applicants have made hoses of ethylene methyl-acrylate OE 5625 (Elvaloy) of DuPont in an AXXON laboratory extruder, type B25, single screw. The following settings were used for this:

| | |
|---|---|
| zone 1 | 225° C. |
| zone 2 | 215° C. |
| zone 3 | 200° C. |
| zone 4 | 185° C. |
| zone 5 | 155° C.. |

The extruder speed and throughput were then so selected as to give a transparent smooth and shiny hose. The optimum speed, throughput and temperature differs per batch of raw material, and can readily be found by trial and error by the skilled artisan.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printing apparatus comprising a printhead, an ink reservoir and a flexible hose for transporting fluid ink from the ink reservoir to the printhead, said flexible hose having a wall which during the transportation of the ink, is in contact with the ink, said wall being made of a single material which is impermeable or substantially impermeable to water and air and substantially resistant to carbon-containing ink.

2. The printing apparatus according to claim 1, wherein the material is an alkylene alkyl-acrylate copolymer, the alkylene being selected from the group consisting of ethylene and propylene and the alkyl-acrylate being selected from the group consisting of methyl, ethyl, propyl and butyl acrylate.

3. The printing apparatus according to claim 2, wherein the material is a copolymer of ethylene and the alkyl-acrylate.

4. The printing apparatus according to claim 3, wherein the alkyl-acrylate is selected from the group consisting of methyl and ethyl acrylate.

5. The printing apparatus according to claim 4, wherein the alkyl-acrylate is methyl acrylate.

6. The printing apparatus of claim 1, wherein the single material comprises a single layer.

7. A flexible hose suitable for transporting fluid ink, said hose having a wall which is adapted for contact with the ink, said wall being made of a single material which is substantially impermeable to water and air and said material being substantially resistant to carbon-containing ink.

8. The flexible hose according to claim 7, wherein the material is an alkylene alkyl-acrylate copolymer, said alkylene portion being selected from the group consisting of ethylene and propylene and said alkyl-acrylate portion being selected from the group consisting of methyl acrylate, ethyl acrylate, propyl acrylate and butyl acrylate.

9. The flexible hose according to claim 8, wherein the material is a copolymer of ethylene and the alkyl acrylate.

10. The flexible hose according to claim 9, wherein the alkyl-acrylate is selected from the group consisting of methyl and ethyl acrylate.

11. The flexible hose according to claim 10, wherein the alkyl acrylate is methyl acrylate.

12. The flexible hose of claim 7, wherein the single material comprises a single layer.

* * * * *